US005546441A

United States Patent [19]

Stege

[11] Patent Number: 5,546,441

[45] Date of Patent: Aug. 13, 1996

[54] X-RAY SYSTEM

[75] Inventor: Peter Stege, Hamburg, Germany

[73] Assignee: U.S. Philips Corporation, New York, N.Y.

[21] Appl. No.: 439,325

[22] Filed: May 11, 1995

[30] Foreign Application Priority Data

May 11, 1994 [DE] Germany ..... 44 16 556.0

[51] Int. Cl.[6] ..... H05G 1/34

[52] U.S. Cl. ..... 378/110; 378/207

[58] Field of Search ..... 378/110, 109, 378/111, 112, 108, 101, 207

[56] References Cited

U.S. PATENT DOCUMENTS

| | | | |
|---|---|---|---|
| 4,177,406 | 12/1979 | Hermeyer et al. | 315/307 |
| 4,775,992 | 10/1988 | Resnick et al. | 378/110 |
| 4,809,311 | 2/1989 | Arai et al. | 378/110 |
| 5,077,773 | 12/1991 | Sammon | 378/110 |

FOREIGN PATENT DOCUMENTS

| | | | |
|---|---|---|---|
| 2703420 | 11/1985 | Germany | H05G 1/34 |

*Primary Examiner*—David P. Porta
*Attorney, Agent, or Firm*—Jack D. Slobod

[57] ABSTRACT

An X-ray system includes an X-ray generator for operating an X-ray tube (1) having a cathode which can be heated by a filament current ($I_h$), a continuation (5, 57) which is operative in an exposure mode so as to boost the filament current to a boost value ($I_b$), and a continuation which is also operative in the exposure mode so as to decrease the filament current and to switch on the tube voltage (U). The time elapsing until the start of exposure is reduced in that the X-ray generator has a special mode in which the filament current is boosted to the boost value ($I_b$) while the tube voltage (U) is switched on, circuitry (4, 6) is provided for measuring the tube current flowing in the special mode. A memory (8) is provided for storing the temporal variation of the measured tube current, or a value ($I_{cor}$) derived therefrom, and the control unit (5, 57) is operative for deriving the boost time from the temporal variation stored in the memory (8).

2 Claims, 2 Drawing Sheets

X-RAY SYSTEM

BACKGROUND OF THE INVENTION

1. Field of the Invention

The invention relates to an X-ray system, comprising an X-ray tube and an X-ray generator for operating the X-ray tube which comprises a cathode which can be heated by a filament current, comprising means which are operative in an exposure mode so as to boost the filament current to a boost value, and means which are also operative in the exposure mode so as to decrease the filament current and to switch on the tube voltage.

2. Description of the Related Art

When such an X-ray system is used to form an X-ray image, for example after prior fluoroscopy, it is desirable to execute the X-ray exposure as quickly as possible. In the case of X-ray tubes comprising a heatable cathode, however, the cathode (or the filament contained therein) must first be heated to a temperature at which it can emit the tube current required for the X-ray exposure.

In order to reduce the time elapsing until the start of exposure it is known to supply the cathode, while the tube voltage is still switched off, with a filament current which is substantially larger than the filament current required for the subsequent X-ray exposure (with the tube voltage switched on). The boost time is governed by the tube current required to flow during the subsequent exposure. The larger this tube current, the longer the boost time will be.

It is already known to store the boost times required for a given type of tube in an X-ray generator in a memory and to fetch these boost times for an X-ray exposure. Such a boost time table in the memory is compiled by the manufacturer of the X-ray tube by way of a complex measuring procedure which is performed separately for each type of X-ray tube. The boost times thus defined are typical values, i.e. it may occur that the cathode temperature at the end of the boost time is higher or lower than the temperature required for the relevant tube current. Therefore, after the boost time the filament current is reduced to the value required for the X-ray exposure. When the tube voltage is switched on after a further time interval of from 200 to 300 ms, the cathode temperature has reached a stationary value which corresponds to the value required for the exposure.

SUMMARY OF THE INVENTION

It is an object of the present invention to provide an X-ray system in which the preparation time, i.e. the period of time elapsing until the beginning of an X-ray exposure, can be reduced even further.

Using an X-ray system of the kind set forth, this object is achieved in that the X-ray generator has a special mode in which the filament current is boosted to the boost value while the tube voltage is switched on, means are provided for measuring the tube current flowing in the special mode, means are provided for storing the temporal variation of the measured tube current, or a value derived therefrom, and means are provided for deriving the boost time from the temporal variation stored in the memory.

It is an essential aspect of the invention that the boost times are determined in a special mode of the X-ray generator in which the tube voltage is switched on and the filament current has been boosted to its boost value. In this mode the tube current continuously increases until it reaches a maximum value, after which the tube voltage is switched off and the filament current is reduced or also switched off. The temporal variation occurring until the instant of switching off is measured and stored. When a given tube current is preset for a subsequent X-ray exposure, carried out in the exposure mode, from the temporal variation stored it can be deduced how long it will take, in the presence of the filament current boosted to the boost value, until the cathode temperature has reached a value at which exactly the desired tube current is emitted. This period of time corresponds to the period of time within which the relevant tube current value has been reached in the stored tube current variation; it is preset as the boost time in the exposure mode.

The invention enables simple, exact determination of the boost times required, that is to say individually for the relevant X-ray tube. The boost time is then exactly as long as necessary to ensure that at the end of the boost time the temperature required for the emission of the desired tube current has been reached exactly. Consequently, the boost time need no longer be succeeded by a second interval during which the filament current is reduced to the value required for the relevant tube current. The preparation time is thus substantially reduced. A further advantage consists in that the special mode of the X-ray generator can be repeated with large time intervals. Aging phenomena affecting the characteristics of the relevant X-ray tube are thus taken into account. When the X-ray tube is replaced, the boost time memory need not be replaced and use can also be made of X-ray tubes with an unknown temperature behaviour.

Generally speaking, the tube current is dependent not only on the filament current but also on the tube voltage applied to the X-ray tube. There are a number of possibilities for determining the boost time associated with a given combination of tube current and tube voltage. One possibility would be to repeat the temporal variation of the tube current in the special mode for a plurality of tube voltages, so that a group of curves would be obtained which would represent the temporal variation of the tube current with the tube voltage as a parameter. Should a given tube voltage be preset in the normal operating mode, the temporal variation of the tube current measured in the special operating mode for the same tube voltage should then be used to determine the tube voltage. This would be comparatively complex, because a plurality of temporal tube current variations would have to be measured and stored in the special operating mode.

However, it suffices to determine the temporal variation of the tube current for a single tube voltage only when, as in a preferred embodiment of the invention, there is provided a second memory in which the stationary filament current values are stored for various tube voltages and tube currents, and the means for deriving the boost time access the first memory and the second memory.

BRIEF DESCRIPTION OF THE DRAWING

The invention will be described in detail hereinafter with reference to the drawing. Therein.

DETAILED DESCRIPTION OF THE PREFERRED EMBODIMENTS

Figure 1:
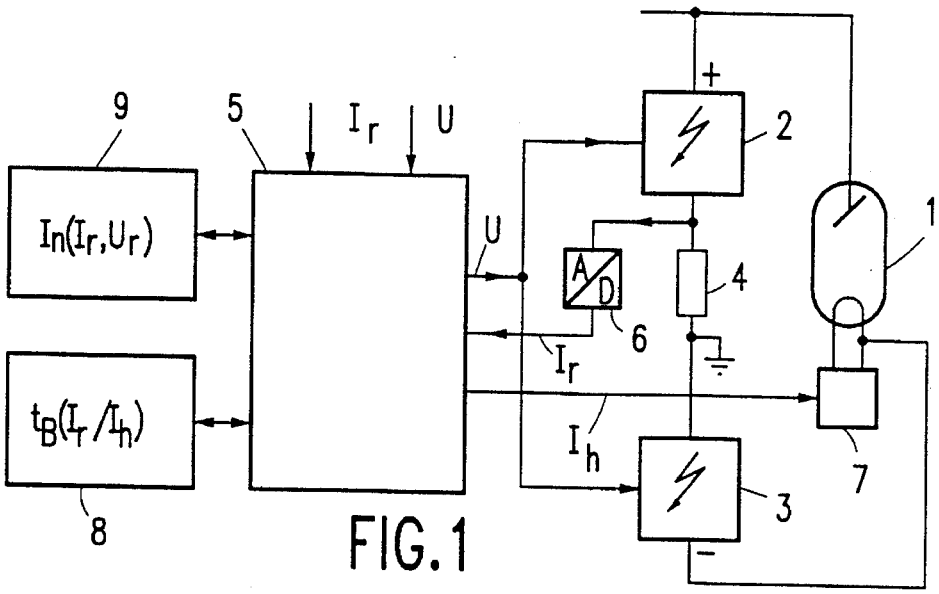
FIG. 1 shows a block diagram of an X-ray generator of an X-ray system in accordance with the invention.

The X-ray generator for powering an X-ray tube 1 as shown in FIG. 1 comprises a first high voltage generating member 2 for generating a positive high voltage for the anode of the X-ray tube and a second high voltage generating member 3 for generating a negative high voltage for the cathode of the X-ray tube. The two high voltage generatoring members 2 and 3 are connected in series via a resistor 4, one end of which is grounded. The resistor 4 serves to measure the tube current flowing across the anode of the X-ray tube 1.

The high voltage generating members 2 and 3, i.e. the temporal variation of the tube voltage U generated thereby, can be controlled by a control unit 5 which may comprise a suitably programmed microprocessor. Via an analog-to-digital converter 6 the control unit receives a value, which is proportional to the voltage drop across the resistor 4, i.e. a value which is proportional to the tube current. Moreover, the control unit determines the filament current for the cathode of the X-ray tube 1 which is generated by a filament current control circuit 7. The control unit cooperates with a first memory 8, storing dynamic dam, and a second memory 9 in which static or stationary data are stored, and combines these data, in a manner yet to be described, with the values of tube current $I_r$ and tube voltage U given for an X-ray exposure.

Figure 2A:
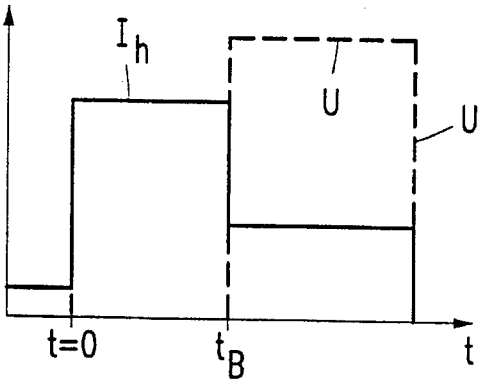
FIG. 2A shows the temporal variation of filament current and tube voltage in the exposure mode.

FIG. 2A shows the temporal variation of the filament current $I_h$ for the exposure mode, the temporal variation of the tube voltage U being represented by a dashed line. It appears that prior to the instant t=0 the filament current is adjusted to a constant quiescent current value, whereas the tube voltage U is not yet present. This quiescent current value is chosen so that no significant tube current would flow if a tube voltage were switched on. 2 amperes is a typical value for the quiescent current.

At the instant t=0, the filament current $I_h$ is boosted to a boost value. This boost value is customarily substantially higher than the tube current flowing during an X-ray exposure and preferably corresponds to the maximum permissible value, for example 11A. The filament current is maintained at this value until the boost time has elapsed, i.e. until the instant $t=t_B$. At the instant $t=t_B$ the tube voltage U for the X-ray exposure is switched on. Moreover, at the instant $t=t_B$ the filament current is lowered to a value of between 3A and 7A, i.e. to a value which is higher than the quiescent current and lower than the boost value. It is not before the instant $t=t_B$ that a tube current can start to flow through the X-ray tube, thus producing X-rays; this means that the actual X-ray exposure does not commence until the instant $t=t_B$. After a predetermined exposure period, or an exposure period dictated by an automatic exposure device, the tube voltage and the tube current are switched off, i.e. the X-ray exposure is terminated.

In order to ensure that the desired tube current already flows at the instant $t=t_B$ and remains constant throughout the X-ray exposure, two conditions must be satisfied:

1. At the end of the boost time ($t=t_B$) the filament current must have heated the cathode to the temperature at which the desired tube current $I_r$ occurs after the switching on of the tube voltage U.

2. The filament current flowing during the X-ray exposure must be exactly so large that the temperature level reached at the instant $t=t_B$ is maintained for the entire X-ray exposure, so that the tube current remains constant or static or stationary.

Figure 3A:
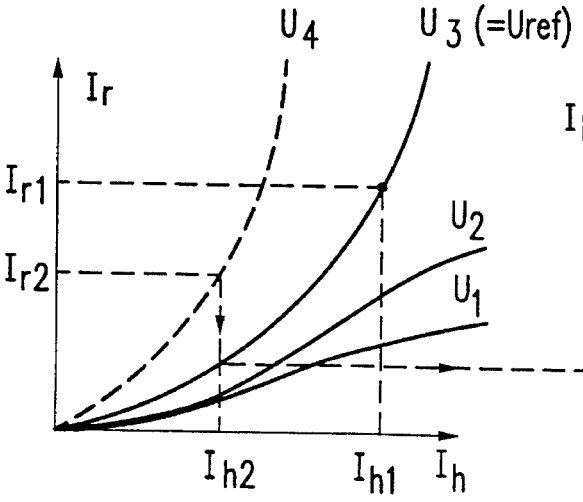
FIG. 3A shows characteristics representing the dependency of the tube current on the filament current with the tube voltage as a parameter in the stationary state.

FIG. 3A shows a stationary family of characteristics which indicates, for various voltages $U_1 \ldots U_4$, the tube current $I_r$ which occurs for a given static or stationary filament current. From this diagram it can be simply deduced which filament current $I_h$ must be adjusted in the stationary case for a given combination of tube current $I_r$ and tube voltage U. This family of curves, i.e. the filament current as a function of the tube current or the tube voltage, is stored in the second memory 9. Individual determination of such a family of characteristics for the relevant X-ray tube is described inter alia in DE-PS 27 03 420 which corresponds to U.S. Pat. No. 4,177,906.

Figure 2B:
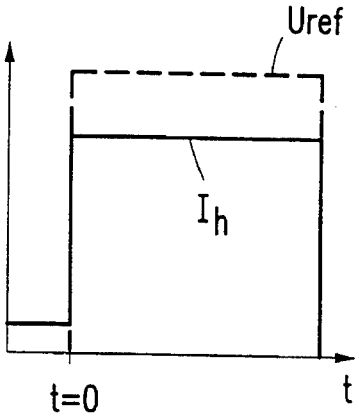
FIG. 2B shows the temporal variation of filament current and tube voltage in the special mode.
Figure 3B:
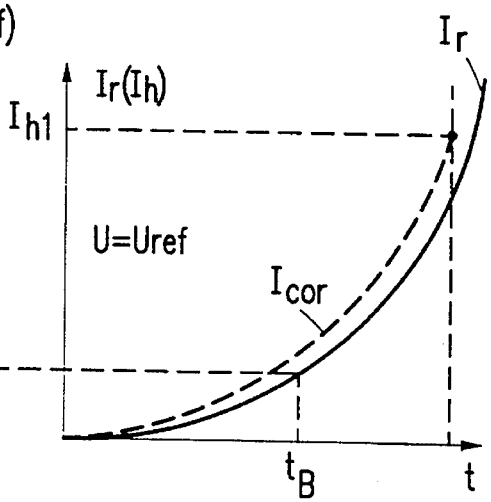
FIG. 3B shows the temporal variation of the tube current in the special mode and a filament current value which can be derived therefrom.

Simple and exact determination of the boost time required for this and other combinations of $I_r$, U will be described in detail hereinafter. To this end, the X-ray generator is operated in the special mode. FIG. 2B shows the temporal variation of the filament current $I_r$ and the tube voltage U in the special mode. Until the instant t=0 the filament current is again maintained at its quiescent current value and it is boosted to its boost value at the instant t=0, which boost value is exactly the same as in the exposure mode. Contrary to the exposure mode, however, at the instant t=0 a voltage $U_{ref}$ is already applied to the X-ray tube, so that an X-ray current can start to flow as soon as the cathode is hot enough. FIG. 3B shows the temporal variation of the tube current $I_r$ as a solid line (be it with a time scale other than the scale used in FIG. 2B). It appears that the tube current initially increases slowly and subsequently ever faster, because the resistance of the cathode, or the filament included therein, becomes higher as the cathode becomes hotter, so that the applied cathode power continuously increases. When the tube current has reached a maximum value, the tube voltage $U=U_{ref}$ is switched off and the filament current $I_h$ is also switched off or reduced.

From the temporal variation of the tube current $I_r$ there can be deduced directly which boost time is required, during a subsequent X-ray exposure with the tube voltage $U=U_{ref}$, to reach a temperature upon elapsing of the relevant boost time which allows for the desired tube current to flow exactly when the tube voltage $U=U_{ref}$ is switched on. Therefore, the temporal variation of the tube current in the special mode is measured and digitized by digitizing the voltage across the resistor 4 by means of the analog-to-digital converter 6, so that for measuring time intervals of, for example 3 ms a respective measurement value of the tube current is available. The variation thus measured is stored in the first memory 8.

Figure 4:
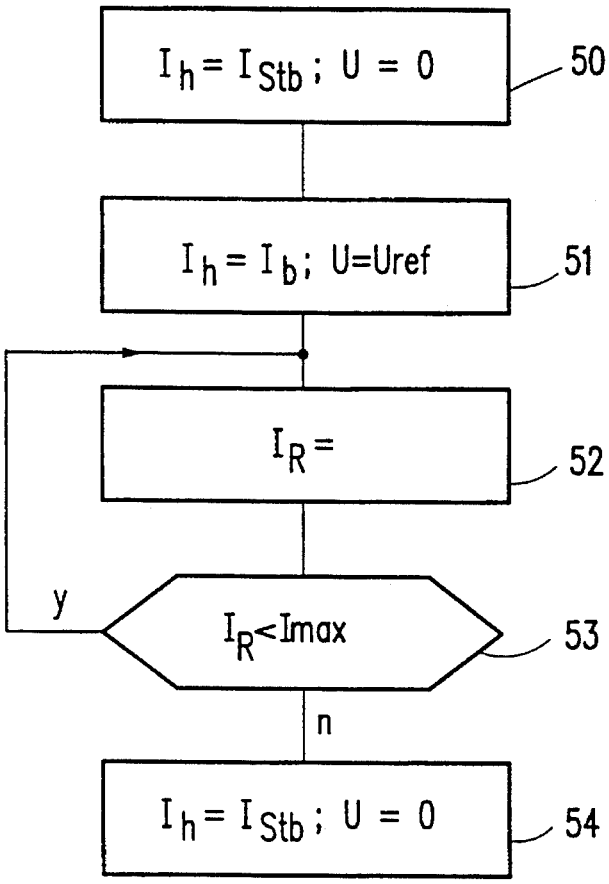
FIG. 4 shows a flow chart for the special mode.

The flow chart of FIG. 4 illustrates the temporal sequence of the steps carried out by the control unit in the special mode. In conformity with block 50 the filament current is first adjusted to a quiescent current value or a standby value $I_{stb}$. The voltage across the tube is switched off. Subsequently (block 51), the filament current is adjusted to the boost value $I_b$ and the tube voltage is adjusted to the value $U=U_{ref}$. At that instant a tube current starts to flow as shown in FIG. 3B. The tube current is measured, digitized every 3 ms and stored in the first memory 8 (block 52). During the next step (block 53) it is checked whether the tube current measured is smaller than a maximum value $I_{max}$ at which the X-ray tube is not yet thermally overloaded. If the current $I_r$ is still smaller, a new measurement is carried out and also a new check etc., until the maximum value has been reached. This is usually the case after from 200 to 300 ms. Subsequently, the filament current is reduced to the quiescent current $I_{stb}$ again and the tube voltage is switched off (block 54).

As has already been stated, the tube current $I_r$ is dependent not only on the filament current $I_h$, but also on the tube voltage. Therefore, if in the exposure mode during a subsequent X-ray exposure a tube voltage is switched on which deviates from the voltage $U=U_{ref}$ present in the special mode, the boost time cannot be derived directly from the variation stored for $U=U_{ref}$. There are a number of possibilities for taking into account this additional temporal dependency of the tube current:

a) In the special mode the temporal variation of the tube current is measured not for a single tube voltage, but for a number of voltages. Should one of these voltages be adjusted during a subsequent X-ray exposure, the boost time could be derived from the temporal variation associated with the relevant voltage. However, the measuring and storage procedure in the special mode must then be repeated several times.

However, the temporal variation of the tube current for only a single voltage $U=U_{ref}$ could also suffice. $U_{ref}$ should then preferably be chosen so that the largest possible tube current ($I_r=I_{max}$) can be reached without thermal overloading of the X-ray tube. A suitable value is, for example 70 kV.

b) A first possibility of making the measurement of the tube current for one tube voltage suffice is diagrammatically shown in the FIGS. 3A and 3B, it being assumed that during a subsequent X-ray exposure an tube voltage $U_4$ is present and that a tube current $I_{r2}$ should flow. During a first step, the filament current $I_{h2}$ (see the dash-dot line in FIG. 3A) being associated with the predetermined combination $U_4$, $I_{r2}$ is extracted from the memory 9. In the second step, the tube current $I_r$ which would flow for the filament current $I_{h2}$ if the voltage $U_{ref}=U_3$ were present across the X-ray tube is fetched from the memory 9. As a third step the boost time $t_B$ associated with this value of the tube current is fetched from the first memory 8.

c) However, two steps may also suffice, provided that previously, for example during the writing of the measurement values of the tube current $I_r$ or thereafter, the curve which is shown as a solid line in FIG. 3B and which represents to the temporal variation of the tube current is transformed once into a curve for the equivalent stationary filament current value (in the stationary case the equivalent stationary filament current would cause exactly the relevant tube current to flow for $U=U_{ref}$). This curve is represented by a dashed line in FIG. 3B and referred to as $I_{cor}$. In FIG. 3A, it is indicated how for a value $I_{r1}$ the associated value $I_{h1}$ can be determined from the solid curve for $U_3$ ($=U_{ref}$). To this end, merely the filament current value $I_{h1}$ (see FIG. 3A) associated with the measured value of $I_{r1}$ and the voltage $U_{ref}$ is extracted from the memory 9 and associated with the measurement time for the value $I_{r1}$. When this is repeated for all measurement values of $I_r$, the curve $I_{cor}$ is obtained (for the sake of simplicity of the drawing, on the ordinate axis different scales hold for the curves $I_h$ and $I_r$).

After the curve $I_{cor}$ (FIG. 3B) has thus been determined once for or after each special mode, for a subsequent X-ray exposure merely the stationary filament current value $I_h$ associated with the preset values of tube current $I_r$ and tube voltage U is determined (from the memory 9 or one of the curves in FIG. 3A), and during a second step the value of the boost time associated with the relevant value $I_h$ on the curve $I_{cor}$ is determined (from the memory 8 or FIG. 3B).

Similar to the stationary characteristics shown in FIG. 3A, this could be repeated for various tube currents $I_r$ and tube voltages, after which in FIG. 3B a family of curves would be obtained which represent the boost time associated with various combinations of tube current $I_r$ and tube voltage U. When these curves are stored, the boost time could be directly derived therefrom in the exposure mode, i.e. without the intermediate step utilizing the curve $I_{cor}$, but only the storage expenditure would then be increased without simplifying the method. This is because prior to each X-ray exposure the value of the filament current which must flow during the subsequent exposure so as to produce the tube current $I_r$ must be determined any way from the stationary characteristics of FIG. 3A or the memory 9. Therefore, it is more effective to derive required the boost time from one X-ray exposure to another from the characteristics stored in the memories 8 and 9.

Figure 5:
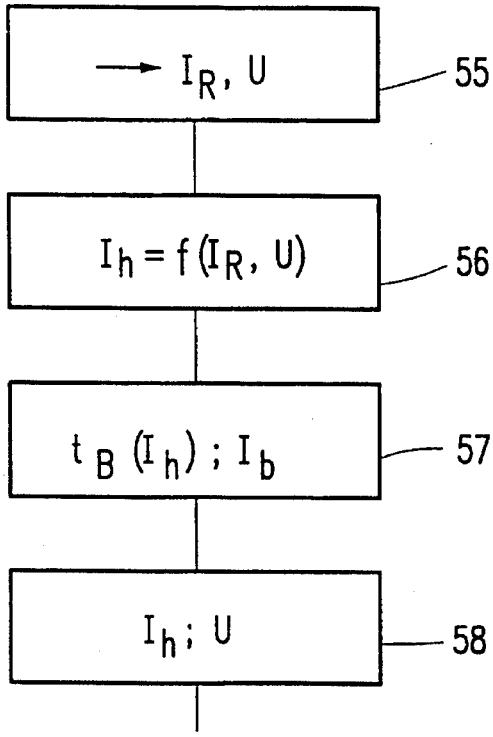
FIG. 5 shows a flow chart for the exposure mode.

In conformity with the block diagram of FIG. 5, the procedure during an X-ray exposure is then as follows: the values of tube current and tube voltage desired for the X-ray exposure are preset (block 55). From these values the stationary filament current required for the X-ray exposure is determined, that is to say by means of the values stored in the memory 9 (block 56). Subsequently, from the curve $I_{cor}$ in FIG. 3B, or from the memory 8, the boost time $t_B$ associated with this filament current value is derived. The filament current is then boosted to the boost value for the period $t_B$ during which no voltage is applied to the X-ray tube (block 57). After expiration of the boost time $t_B$, the filament current is reduced to the value determined in the block 56 and the desired tube voltage U is switched on (block 58). The desired tube current $I_r$ then flows.

In some examination methods an X-ray exposure is preceded by fluoroscopy during which the tube current $I_r$ has a small but not negligible value. If in the exposure mode the filament were subsequently heated for the full boost time determined in the described manner, the temperature would become slightly too high. This can be prevented by reducing said boost time by the value of the boost time associated with the filament current $I_h$ flowing in the fluoroscopy mode.

I claim:

1. An X-ray system, comprising an X-ray tube and an X-ray generator for operating the X-ray tube which comprises a cathode which can be heated by a filament current, comprising means which are operative in an exposure mode so as to boost the filament current to a boost value, and means which are also operative in the exposure mode so as to decrease the filament current and to switch on tube voltage, characterized in that the X-ray generator has a special mode in which the filament current is boosted to the boost value while the tube voltage is switched on, means are provided for measuring the tube current flowing in the special mode, means a first memory is provided for storing the temporal variation of the measured tube current, or a value derived therefrom, and means are provided for deriving the boost time from the temporal variation stored in the first memory.

2. An X-ray system as claimed in claim 1, wherein there is provided a second memory in which stationary values of filament current are stored for various tube voltages and tube currents, and that the means for deriving the boost time accesses the first memory and the second memory.

* * * * *